United States Patent [19]

McKinley

[11] 4,354,684

[45] Oct. 19, 1982

[54] BUSINESS STRATEGY BOARD GAME

[76] Inventor: Paul F. McKinley, 118 N. Winebiddle Ave., Pittsburgh, Pa. 15224

[21] Appl. No.: 212,756

[22] Filed: Dec. 4, 1980

[51] Int. Cl.[3] ..... A63F 3/00

[52] U.S. Cl. ..... 273/256; 273/249

[58] Field of Search ..... 273/256, 249, 243, 257

[56] References Cited

U.S. PATENT DOCUMENTS

| | | | |
|---|---|---|---|
| 2,174,058 | 9/1939 | McGennis | 273/256 |
| 2,723,857 | 11/1955 | Miller et al. | 273/243 |
| 3,740,038 | 6/1973 | Feulner | 273/243 |
| 3,889,955 | 6/1975 | Welch et al. | 273/257 |
| 4,010,955 | 3/1977 | Nelson | 273/243 |
| 4,013,294 | 3/1977 | Smeda et al. | 273/249 |
| 4,046,381 | 9/1977 | Comeaux | 273/249 |
| 4,068,848 | 1/1978 | Lichtman et al. | 273/257 |

FOREIGN PATENT DOCUMENTS

| | | | |
|---|---|---|---|
| 1107850 | 3/1968 | United Kingdom | 273/243 |
| 1432761 | 4/1976 | United Kingdom | 273/256 |

*Primary Examiner*—Richard C. Pinkham
*Assistant Examiner*—Scott L. Brown

[57] ABSTRACT

A business strategy game is provided, such game including a game board having a playing area, said playing area having a plurality of playing token resting spaces, and a plurality of progress sections, each having a plurality of playing token resting spaces. Playing tokens for each player are positioned on the playing area and are movable thereon. The playing tokens are moved about the game playing area in turn in a directed fashion, as indicated by the random roll of dice. Other playing tokens are advanced in coordinated manner as dictated by performance of instructions contained in indicia associated with the playing token resting spaces of the playing area, from beginning positions toward separate goals in separate progress sections. Two sets of instruction cards with different instructional indicia are utilized in playing. One or the other sets of cards is brought into play from time to time during the course of the game, pursuant to instruction indicia associated with the playing token resting spaces of the game board playing area. Random selection means, such as playing dice, are operated by each player in turn to determine their respective playing tokens circuitous movement about the playing token resting spaces of the gameboard playing area.

6 Claims, 9 Drawing Figures

NOTE, SCALE - ONE THIRD SIZE

NOTE, SCALE-FULL SIZE

FIG. 6
STOLITICS
NAME _____
PERSONAL ACCOUNTS RECORD SHEET
| STOCK (shs) | CASH ($) |
|---|---|
| 20 | $40 |
FIG. 7A
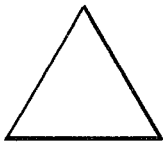
PLAN VIEW
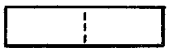
END VIEW
FIG. 7B
NOTE, SCALE-FULL SIZE

BUSINESS STRATEGY BOARD GAME

SUMMARY OF THE INVENTION

This invention relates to a business strategy board game in which the players employ business-like tactics and strategies to achieve simulated business progress and positions with respect to certain business-related goals, and for which a high degree of skill and thought is required in the play thereof.

In its broader aspects, the business game of this invention comprises a game board having a playing area provided with a closed circuit of sequentially arranged playing token resting spaces, at least some of which are provided with instructions for performance of various simulated business activities affording progress of players with respect to one or more business-oriented goals. The game of this invention also includes a first progress section having a plurality of serially arranged playing token resting spaces, provided with indicia signifying the players' progress toward a first business-oriented goal, such as successive managerial rank. The game of this invention also includes a second progress section, also having a plurality of playing token resting places provided with indicia signifying progress toward a second business-oriented goal, such as career service time. This second progress section may be located on the surface of the game board, along with the playing area and the first progress section, but to avoid crowding, it is preferably positioned on a separate, auxiliary playing surface. Play is effected by the players' movement of their respective playing tokens sequentially through the playing token resting spaces, performing the instructions associated with such spaces, and by corresponding movement of the playing tokens sequentially through the playing token resting spaces in the progress sections. Movement of the playing tokens within the playing area is determined by random selection means, such as a playing die or playing dice. Movement of the playing tokens in the progress sections corresponds to the progress achieved by the players toward the goal or goals, as determined by the results of performing the instructions indicated in the playing token resting spaces within the playing area. The game ends when a player reaches the goal in the paramount progress section.

In its more specific aspects, the game of this invention includes a first stack of instruction cards provided with a plurality of instructions for the optional performance of simulated business activities, and a second stack of instruction cards provided with a plurality of instructions for the optional and mandatory performance of simulated business activities.

In a still more specific aspect, the game of this invention includes means for indicating a simulated price per share of stock and random selection means, such as a playing die or spinner for selection of a particular share price.

BRIEF DESCRIPTION OF THE DRAWINGS

The invention may be best understood from the following detailed description of a preferred embodiment thereof in connection with the accompanying drawings, in which like numerals designate like elements, and in which

FIG. 6 is a plan view of the face side of a recording sheet adapted to keep track of stock and cash transactions that may occur within the game.

FIG. 7A is a plan view of a typical playing token.

FIG. 7B is an end view of the playing token of 7A.

DETAILED DESCRIPTION OF THE INVENTION AND THE PREFERRED EMBODIMENT

Figure 1:
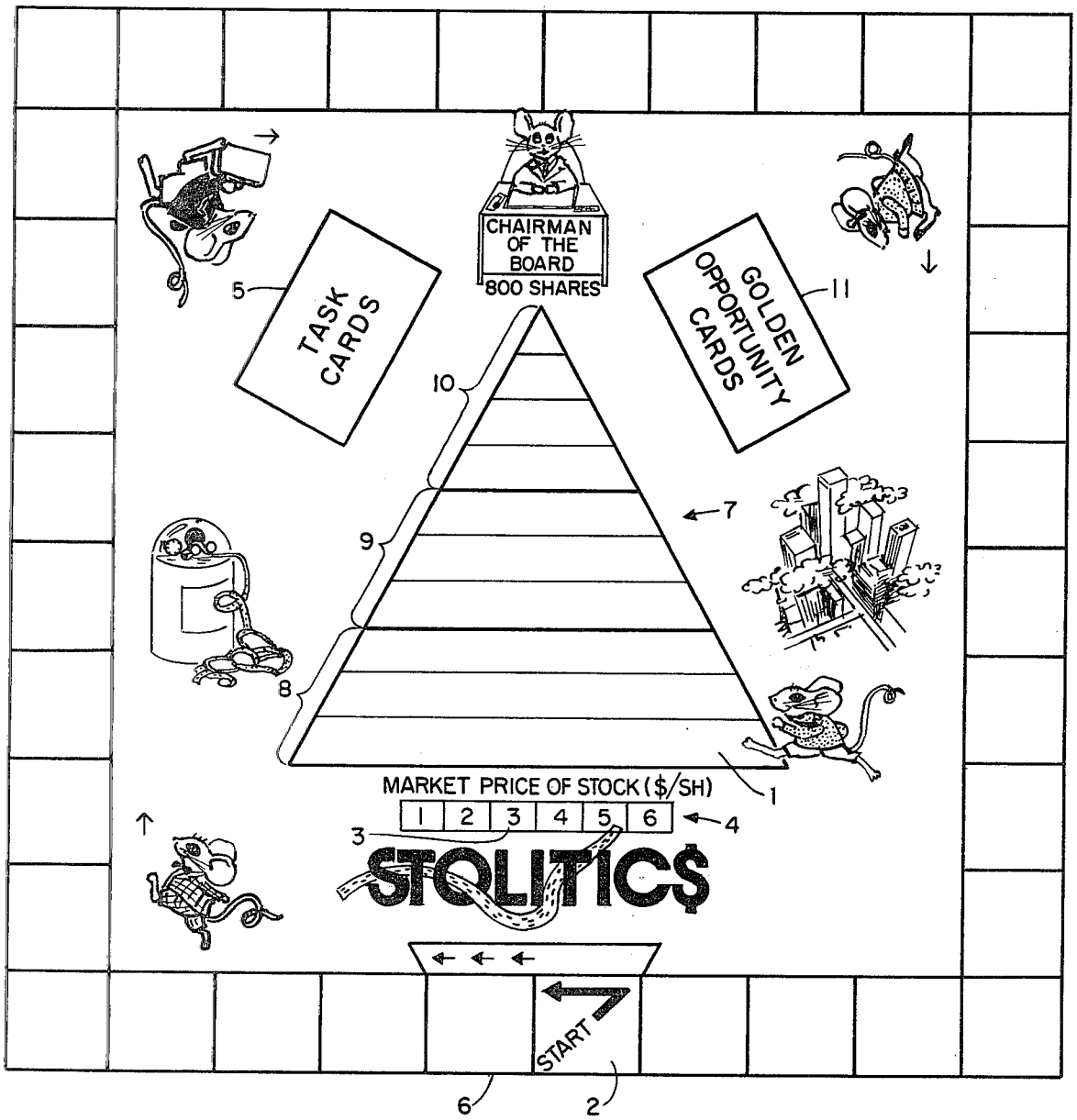
FIG. 1 is a plan view of a board game according to the present invention, comprising a closed circuit perimeter playing area and a first triangular progress section adapted to register successive corporate managerial ranks of the players, and the manner in which the game design is laid out and the movement of game tokens occurs.

Referring particularly to FIG. 1 of the drawings, there is shown the game board of this invention. The game board will normally be constructed of a sheet material such as cardboard, paper, wood, cloth or plastic. The game board is preferably of a square configuration. However, any desirable type of configuration which will encompass at least the playing area resting spaces and at least one progress section may be employed.

The game board includes a plurality of sections. Numeral 6 denotes a closed circuit of sequentially arranged playing token resting spaces, comprising the playing area.

Numeral 7 denotes a triangular shaped, first progress section having a plurality of levels, each successive level corresponding to successively increasing managerial rank in the business organization of the same.

Numeral 4 denotes an indicator showing multiple stock share prices.

The playing area 6 is divided into a plurality of playing token resting spaces or perimeter blocks, thirty six (36) in number each with separate instructional indicia as indicated below. The perimeter blocks begin with the start block 2 and are arranged sequentially about the perimeter of the game board in a clockwise fashion from the start block 2.

Specific examples of instructional indicia of the kind which are to be included within the thirty-six perimeter blocks, or playing token resting spaces are set forth below:

EXAMPLES OF INSTRUCTIONS TO BE USED IN PLAYING TOKEN RESTING SPACES (PERIMETER BLOCKS) IN PLAYING AREA

Example 1

Buy or Sell Stock
Take Self Promotions
Add 4 Years of Service
START

COLLECT $400.00 Equal to Double your 4 Years Salary

Example 2

TAKE ONE TASK CARD (2)

Example 3

POOR PERFORMANCE EVALUATION (4)
Lose 1 Turn Or Pay $200.00 Etc.

Example 4

BUSINESS TRIP (4)
Collect $50.00 for Expenses But Lose 1 Turn

Example 5

EMPLOYEE STOCK OPTION BENEFITS
Add 30 Shares of Stock To Your Stock Account

Example 6

COLLECT COMMISSIONS
Add $50.00 to Your Cash Account

Example 7

STOCK SPLIT
Roll Dice
Even—2 for 1
(Double Your Stock)
Odd—1 for 2
(Lose ½ Your Stock)

Example 8

PROMOTION
Move Up One Position Level
Board Positions Excluded

Example 9

INFLATION REDUCES BUYING POWER (2)
Deduct $20.00 From Your Cash Account

EXAMPLE 10

FAST TRACK BLOCK
Move To The Next Fast Track Block

Example 11

TRANSFER TO ANOTHER DIVISION (3,4)
Lose 4 Years of Service

Example 12

PERSONAL BUSINESS VENTURE FAILS (1)
Deduct $100.00 And 10 Shares of Stock To Finance Debt Example 13

STOCK TRANSACTIONS BLOCK
Buy or Sell Stock At The Present Price
Consider Self-Promotions Example 14

COST OF LIVING INCREASE
Add $20.00 To Your Cash Account

Example 15

COLLECT COMMISSIONS
Add $50.00 To Your Cash Account

Example 16

EXCELLENT PERFORMANCE EVALUATION
Move Up One Position Level

Example 17

SICK LEAVE
Skip One Turn But Collect $35.00 Disability Insurance

Example 18

DECISION BLOCK
To Move Forward Roll 1 or 2 Dice And Predict An Even or Odd Roll,
If Incorrect, Move in Reverse Example 19

STOCK SPLIT
ROLL DICE
Odd—2 and 1
(Double your Stock)
Even—1 for 2
(Lose ½ Your Stock)

Example 20

TAKE ONE TASK CARD (3,4)

Example 21

CORPORATE MANPOWER RE-ORGANIZATION
Take Another Turn

Example 22

FAST TRACK BLOCK
Move to The Next Fast Track Block

Example 23

TEMPORARY LAYOFF (3,4)
SKIP ONE TURN
But Collect $45.00 UNEMPLOYMENT INSURANCE

Example 24

COLLECT COMMISSIONS
Add $50.00 To Your Cash Account

Example 25

STOCK DIVIDEND DECLARED
Add 10 Shares to Your Stock Account

Example 26

CHARITY FUND DRIVE
Deduct $20.00 From Your Cash Account
If Board Member, Deduct $50.00

Example 27

STOCK TRANSACTIONS BLOCK
Buy or Sell Stock At The Present Price
Consider SELF PROMOTIONS Example 28

PROFIT-SHARING BONUS
Add $70.00 To Your Cash Account

Example 29

PERSONALITY CONFLICT
Drop One Position Level

Example 30

DECISION BLOCK
To Move Forward Roll 1 or 2 Dice And Predict An Even or Odd Roll

If Incorrect, Move In Reverse

Example 31

FAST TRACK
Move To The Next Fast Track Block

Example 32

TAKE ONE TASK CARD (1,4)

Example 33

COLLECT COMMISSIONS
Add $50.00 To Your Cash Account

Example 34

CORPORATE AUSTERITY PROGRAM (1)
Deduct $50.00 From Your Cash Account

Example 35

STOCK-SPLIT
Roll Dice
Even—2 For 1
(Double Your Stock)
Odd—1 for 2
(Lose ½ Your Stock)

Example 36

TAXES
Roll Dice And Deduct The Amount From Your Cash Account
Even $100
Odd $200

The numbers to the right of the title of the instructional indicia in Examples 2, 3, 4, 9, 11, 12, 20, 23, 32 and 34 signify playing options for any player whose playing token comes to rest on these blocks, as described more fully below.

During play, the players' playing tokens are advanced in turn about the playing token resting spaces, from the starting block 2, in accordance with random selection means, such as a pair of standard playing dice.

Of course, the instructional indicia of Examples 1–36 can be varied, if desired.

Figure 8:
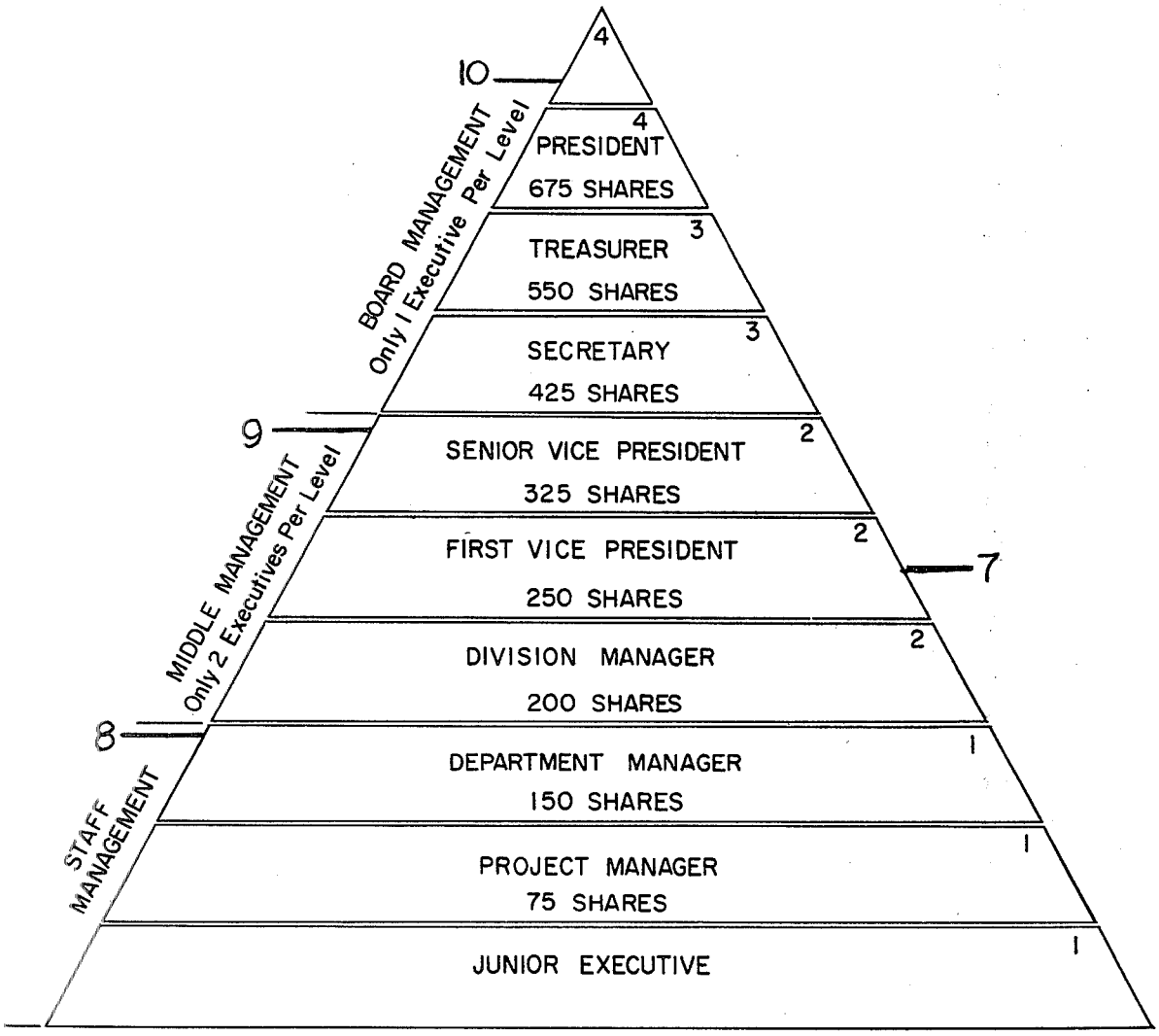
FIG. 8 is an enlarged plan view of the progress section of FIG. 1 shown with progress indicia.

As indicated above, the game board is characterized in part by a first triangular progress section, indicated by numeral 7 in FIGS. 1 and 8, such first progress section being provided with a number of position levels (here ten) with indicia signifying successive managerial ranks, as designated in FIG. 8. The sections of progress section 7 indicated by numerals 8, 9 and 10 correspond respectively to staff management, middle management, and board of directors management position levels. Specific examples of ten successive managerial ranks are shown in FIG. 8. According to this particular embodiment, only one playing token is allowed per position level for each of the topmost four Board of Directors position level. Only two playing tokens are allowed for each position level for the middle management ranks.

Figure 2:
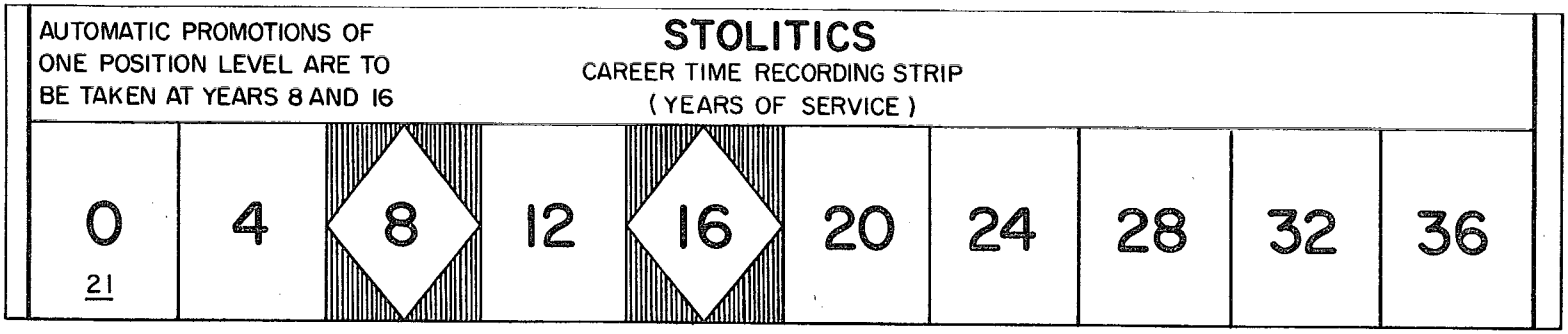
FIG. 2 is a plan view of a second progress section adapted to register the accumulated years of service which a player aggregates.

Another component of the game is a second progress section, here a horizontal strip block, as shown in FIG. 2, on which a player moves a playing token. This horizontal strip block progress section allows a player to record his progress in his circuitous movement around the game board's perimeter blocks and toward attainment of a second goal, shown here in terms of successively increasing years of career service. Movement of a player's playing token on this second progress section is coordinated with movement of the same player's playing token in the first progress section. The coordinated movement occurs when a player's playing token comes to rest on the two diamond shaped blocks shown in FIG. 2. At such times, vertical movement of one position level in the first progress section by a player's game token is permitted.

Each player is issued three playing tokens, such as those illustrated in FIGS. 7A and 7B at the outset of the game's play. Each player's playing tokens are differentiated from each other player's game tokens in any convenient way, such as by distinctive colors.

Figure 5:
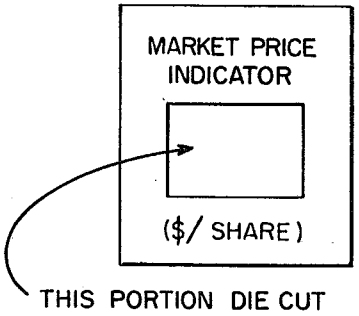
FIG. 5 is a plan view, face side, of an indicating means for noting the value of the price of simulated stock shares at a given time during the course of the game.

A market price indicating device, here a card having a centrally located aperture, is shown in FIG. 5. This market price indicator is used in conjunction with block strip 4 on the game board of FIG. 1, where the indicator is used to frame the applicable stock share price at the time in question. The placement of this device is determined by random selection means, as by the roll of a single standard playing die.

Figure 4:
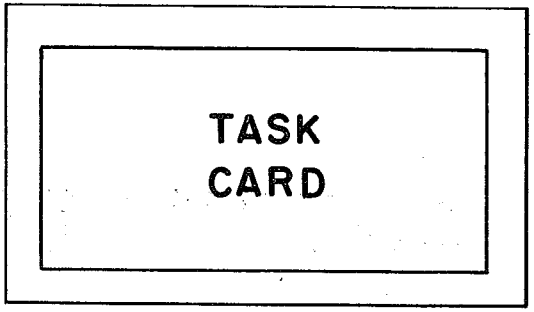
FIG. 4 is a plan view, face side, of a playing card containing optional or mandatory instructions, here entitled "Task Card".
Figure 3:
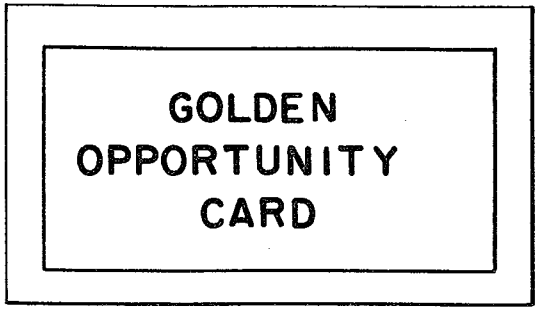
FIG. 3 is a plan view of the face side of a playing card containing optional instructions on its opposite side, here entitled "Golden Opportunity Card".

On the game board of FIG. 1, two areas denoted by numerals 5 and 11, are allocated for storing card stacks. "Task Cards" such as illustrated in FIG. 4 and containing mandatory instructional indicia on the reverse side are stored in area 5 to the left of the triangular progress section 7. "Golden Opportunity Cards", such as illustrated in FIG. 3, and containing optional instructional indicia on the reverse side are stored in area 11 to the right of the triangular progress section 7. Specific examples of the instructional indicia included in the Task Cards, sixteen in this embodiment, are shown in Examples I–XVI, below.

Example I

A TIMELY INVESTMENT
Your oil and gas venture corporation makes a big strike—Collect a $100 capital gain.
(Can be used only once)

Example II

POWER PLAY #5
Promote yourself one level to any unoccupied position.
(Can be used only once)

Example III

POWER PLAY #12
Take one extra turn.
(Can be used only once)

Example IV

POWER PLAY #4
Advance yourself to any activity block up to the block you presently occupy.
(Can be used only once)

Example V

REVERSE MOVE IMMUNITY CARD
Protection from reverse moves when requested by a TASK CARD.
(Can be used only once)

Example VI

POWER PLAY #10
Provides immunity from being bumped down (demoted) one position level.
(Can be used at any time but only once)

Example VII

TAX SHELTER
Provides protection throughout the game.
Pay only one-half the normal amount when taxed.

Example VIII

POWER PLAY #9
Advance any executive to any activity block up to the block that he presently occupies.
(Can be used only once)

Example IX

POWER PLAY #12
Take one extra turn.
(Can be used only once)

Example X

STOCK OPTIONS
Purchase any amount of stock at one-half the present market price when it is your turn.
(Can be used only once)

Example XI

POWER PLAY #11
This card, together with another Power Play Card #11 (yours or another executive's), can be used to demote any executive one level.
(Can be used at any time but only once)

Example XII

POWER PLAY #3
Demote any executive one level.
(Can be used only once)

Example XIII

ESTATE INHERITANCE CARD
Inherit 55 shares of stock.
(Can be used only once)

Example XIV

POWER PLAY #8
Trade position levels with the executive one level above you.
(Can be used only once)

Example XV

POWER PLAY #3
Demote any executive one level.
(Can be used only once)

Example XVI

POWER PLAY #7
Elect to have any executive skip his next turn.
(Can be used at any time but only once)

Specific examples of the instructional indicia included on the Golden Opportunity Cards, twenty four in this embodiment, are shown in Examples A–X below.

Example A

POWER PLAY #11
This card, together with another Power Play Card #11 (yours or another executive's), can be used to demote any executive one level.
(Can be used at any time but only once)

Example B

FOREIGN ASSIGNMENT
Skip your next turn, but add 4 years of service.
(Can be used only once)

Example C

POWER PLAY #6
Protection from demotions when indicated by an activity block.
(Can be used only once)

EXAMPLE D

POWER PLAY #10
Provides immunity from being bumped down (demoted) one position level.
(Can be used at any time but only once)

Example E

REVERSE MOVE IMMUNITY CARD
Protection from reverse moves when requested by a TASK CARD.
(Can be used only once)

Example F

POWER PLAY #2
You are given control of the corporation and elected President. Advance to the President's Position level. May be used only if within two levels of the Presidency.
(Can be used only once)

Example G

POWER PLAY #1
Deduct 4 years of service from any executive who is on your level or on a lower level.
(Can be used only once)

Example H

POWER PLAY #6
Protection from demotions when indicated by an activity block.
(Can be used only once)

Example I

You have missed your project's deadline and forfeit a lucrative contract.
Move back 5 blocks.

Example J

Successfully complete your boss's special project.
Advance 4 blocks.

Example K

You have incorrectly predicted business conditions—the corporation's profits fall.
Move back 3 blocks.

Example L

Make your boss "shine" at a corporate board meeting.
Advance 5 blocks.

Example M

Take an overdue vacation.
Skip your next turn but collect $30 vacation pay.

Example N

You have given a very poor sales presentation.
Move back 4 blocks.

Example O

You have correctly forecasted business conditions—the corporation's profits increase.
Advance 6 blocks.

Example P

Acquire a new customer's account.
Collect a bonus of 35 shares of stock and take another turn.

Example Q

You were late for work and then you fell asleep at a "bored" meeting.
Move back 1 block.

Example R

Suggest a new work procedure to your boss.
Advance 1 block.

Example S

Your poor management practices result in the loss of the corporation's largest and oldest account.
Move back 6 blocks.

Example T

You have given a successful sales presentation.
Advance 3 blocks.

Example U

You worked overtime to meet a contract deadline.
Advance 1 block.

Example V

If a Division Manager or higher, you are found guilty of anti-trust violations.
You are fined $100 and lose your next turn.

Example W

You are snowbound at the airport and miss a top-level meeting.
Lose your next turn.

Example X

The Government accuses you of personal income tax evasion.
You plead no contest and settle quietly by losing your next turn.

The game of this invention may be played by 2, 3 or 4 players. In the course of the game, success is achieved by way of power politics and control of common stock within a corporate system. Common stock is a non-physical element employed during the game's play. The object of the game is to become Chairman of the Board and accumulate at least twenty-four years of service. The first player to reach these objectives is declared the winner To play the game, each player begins his career with:

(a) A set of three playing tokens, (b) A Personal Accounts Record Sheet, (c) Six Golden Opportunity (G.O.) Cards shuffled and dealt face down.

(d) A Career Time Recording Strip.

(e) Twenty shares of stock and $40 cash as indicated on the Personal Accounts Record Sheet of FIG. 6.

At commencement of play, each player places one playing token on the "Junior Executive" position level 1, one on the Start Block 2, and one on the zero position 21, of his Career Time Recording Strip FIG. 2. The Market Price Indicator is placed on the $3 per share block of the Market Price Per Share Strip 4. The shuffled pack of Task Cards is placed face down in area 5 on the game board 7. Each player rolls the pair of dice, and the player who rolls the lowest total number of dots starts the game. Each other player then rolls the dice in his turn. Players then move clockwise from the starting block 2 around the board by rolling both dice and moving a number of perimeter blocks equal to the random roll value of the dice, corresponding to the sum value of dots face up on the dice.

If a player rolls doubles, i.e., two dice having the same number of dots face up, he may choose to move any number of perimeter blocks less than or equal to the total number of dots on the dice. For example, a roll of double "threes" allows the player to move any number of blocks he chooses, from one to six. A player must perform the procedure required by the perimeter block on which he lands unless:

(a) he holds a Golden Opportunity Card providing exemption from performing that activity, or (b) he is exempted by the power option of his position level on the triangular corporate rank progress section 7.

Any number of players is allowed on an perimeter block at any given time.

A player receives a salary of $200 each time he passes the Start Block 2 in a clockwise direction. Upon each such occurrence, this amount is added to the cash column on his personal accounts record sheet. If the player lands directly on the Start Block 2 the salary collected is $400.

Stock can only be bought or sold when a player:

(a) lands on a Stock Transaction block, for example, see Examples 1, 5 and 7, (b) passes or lands on the starting block 2, or (c) is the holder of an appropriate GOLDEN OPPORTUNITY Card indicating the player's option to buy or sell stock.

A player determines the number of shares of stock he can buy by dividing his available cash by the Market Price Per Share, as indicated at that time. The resulting amount is the maximum number of stock shares that can be purchased. The player may choose to buy any number of shares above ten, minimum, up to this maximum number, for example: to buy 100 shares of a $3 per share stock requires 100 shares $\times$$3 per share=$300 in the player's cash account. Purchase is effected by deducting $300 from the player's cash account and 100 shares are added to his stock account.

A player can sell stock by multiplying the Market Price Per Share at the time by the number of shares to be sold. This will give the resulting amount of cash he will receive from the stock sale, for example: the sale of 100 shares of stock at $3 per share will add $300 to the player's cash account, and simultaneously will reduce the player's stock account by 100 shares.

Entry to elevated position levels on the corporate position level triangle is made by accumulating shares of stock. The amount of stock a player must hold to gain entry to each position level is as indicated for the respective position levels in the triangle. Promotions to higher positions are taken when a player:

(a) lands on a perimeter block which is entitled Stock Transaction Block, (b) passes or lands on the starting block, (c) lands on a perimeter block which indicates self-promotion, or (d) uses an appropriate Golden Opportunity Card.

A player is not demoted if he is caused to lose stock which results in his holding less stock than required for the position level that he then occupies. However, a player may not sell stock during the time resulting in his holding less than the required number of shares for his position level. Players are permitted to move up a maximum of only two position levels per promotion. Only one promotion is allowed per turn. Compulsory automatic promotions of one position level occur at 8 and 16 years of service in the present embodiment, as indicated on the Career Time Recording Strip. Additional promotion moves are not permitted at this time.

The Market Price Per Share of stock changes value only when a player purchases stock after passing or landing on the starting block. The Market Price Per Share is determined by rolling one die. The Market Price Indicator Fig. is moved to correspond to the face value of the die thus rolled. A player who wishes to change the Market Price Per Share must buy at least ten shares of stock at the new price and have at least $60 in his cash account. Stock purchases or sales from perimeter blocks designated as stock transaction blocks are carried out using the indicated market price per share at that time, as denoted by the Market Price Indicator.

Players add four years of service each time they pass or land on the starting block when moving in a clockwise direction. The player records his accumulated career time by moving his playing token on the Career Time Recording Strip. A player is entitled to add four years of service after first collecting his salary, purchasing or selling stock, and taking self-promotions.

If a player moves counterclockwise over the starting block and on his next turn proceeds to move forward (clockwise) over the block, he can add another four years of service, collect salary, purchase or sell stock, or take self-promotions.

Golden Opportunity Cards are played when a player takes his turn, unless otherwise indicated by the card. Any number of cards may be used during a single turn. Golden Opportunity Cards should be placed face down on the game board after use.

The corporate position level progress section is divided into three major groups of position levels—Staff Management, 3 levels, Middle Management, 3 levels, and Board Positions, 4 levels. Any number of players' game tokens is allowed on a Staff Position level. Any two players' game tokens are allowed on a Middle Management level, but only one player's game token is allowed per Board Position level.

Players can demote other players by exchanging position levels when moving up or down the position level progress section. The player on the move between levels has seniority and can decide who to demote, if there happens to be two players on the level to which he is moving. A player gains protection from demotion if he possesses a Golden Opportunity Card stating that such immunity, see Example VI. The player who then attempts to demote the holder of this Golden Opportunity Card is defeated in his demotion attempt and is forced to lose a turn. The Golden Opportunity Card should be placed face down on the game board after it is used.

Optional moves during play are as follows:

Any player may decline to perform the activity printed on the following perimeter blocks:

(a) Fast Track Blocks (Examples 10, 22 and 31)

(b) Stock Transaction Blocks (Examples 13 and 27)

(c) Decision Blocks (Examples 18 and 30)

All position levels on the corporate position level progress section except for the Junior Executive level have a number (1, 2, 3 or 4) on the upper right hand corner of the level. Certain perimeter blocks also have numbers on their indicia (Examples 2, 3, 4, 9, 11, 12, 20, 23, 32 and 34). Any player who lands on a perimeter block that has a number equal to the number on the position level he occupies may decline to perform the instruction on that perimeter block.

Any player with negative values for both cash and stock is declared bankrupt. A bankrupt player is removed from the corporation and is retired from the game.

When a player moves counterclockwise, he is required to perform the instruction as indicated by the perimeter block on which he lands. Reverse moves result in a player performing the function of only the first block on which he lands while moving in reverse. Any additional blocks moved to from that point are not to be played.

As a particular feature of the game of this invention, the players may choose to modify these policies and procedures. Many choices are available. Examples of two possible variations are:

(a) The required number of years of service to achieve Chairmanship of the Board and to win the game may be changed from twenty-four to a greater number of years, for example, twenty-six years, by a consensus vote of the players.

(b) The player who becomes Chairman may be required to remain in the position for a period of consecutive career service years, for example four or eight years, before he is declared the winner.

Many variations of the specific features of the game of this invention which do not depart from the spirit or scope thereof will occur to those skilled in the art. Accordingly, it is understood that the specific embodiment disclosed herein is by way of illustration only and is not intended as limiting.

What I claim is:

1. A business game comprising:

a game board having a starting space and a closed circuit of sequentially arranged playing token perimeter resting spaces, each such space being provided with instructions to players for performance of simulated business activities, and, on occasion, for choosing a mandatory instruction card from a designated stack of such cards, whereby the performance of at least some of such instructions will afford progress of a player with respect to at least one of a plurality of business-oriented goals, said game board also having a first progress section, common to all players, such first progress section being located within the perimeter resting spaces and being provided with a plurality of playing token resting spaces diminishing in number from the starting position which is adapted to be occupied by a plurality of playing tokens to a single finishing position which is adapted to be occupied by only a a single playing token, said playing token resting spaces increasing in value toward the finishing position with respect to one of said plurality of goals and signifying the players' progress toward such goal; the movement of the players' playing tokens in said first progress section being coordinated at least in part with the movement of the players' tokens in a second progress section;

a second progress section having a plurality of sequentially arranged playing token resting spaces signifying a player's progress toward a second business-oriented goal;

separate playing tokens for said playing section and each of said progress sections, said playing tokens being adapted to be moved sequentially through said playing section and said progress sections; said playing tokens being provided with distinctive indicia to distinguish the playing tokens of each player from those of each other player;

a first set of instruction cards, such cards being provided with a plurality of mandatory instructions to players to perform optional, simulated business activities;

a second set of opportunity instruction cards, such cards being provided with a plurality of optional and mandatory instructions to players to perform simulated business activities to be dealt to the players, the instructions of which may be performed by a player at his option during any one of his playing turns, so as to enable the players to exercise some discretion in the movement of their playing tokens;

random selection means for operation by a player during his playing turn to direct such player to move his playing token circuitously about the playing token resting spaces, the length of the path of such movements being determined by the random selection means.

2. The business game of claim 1, wherein the random selection means is a pair of standard playing dice.

3. The business game of claim 1, wherein the advancement by the players' playing tokens toward the business goal in said first progress section occurs, in part, through the progressive accumulation of non-physical credit units.

4. The business game of claim 3, wherein the credit units are in terms of stock shares and cash, said game also including stock share price indicating means, adapted to indicate randomly selected share prices at which simulated purchase and sale of stock shares can be made.

5. The business game of claim 1, wherein the "stock" price fluctuations are determined by the random roll of a standard playing die.

6. A business game comprising:

a game board having a starting space and a closed circuit of sequentially arranged playing token perimeter resting places, each such space being provided with instructions to players for performance of simulated business activities and, on occasion, for choosing a manadatory instruction card from a designated stack of such cards, whereby the performance of at least some of such instructions will afford progress of a player with respect to a plurality of business-oriented goals, said game board having a first progress section common to all players, such first progress section being located within the perimeter resting spaces and being provided with a plurality of playing token resting spaces diminishing in number from the starting position, which is adapted to be occupied by a plurality of playing tokens, to a single finishing position corresponding to one of said business-oriented goals, said finishing position being adapted to be occupied by only a single playing token, the playing token resting spaces of said first progress section also being provided with indicia signifying corporate management positions of increasing rank from the starting position to the single finishing position, advancement of the players' playing tokens toward the business goal in said first progress section being coordinated in part with progressive accumulation and simulated purchase of stock credit units, said stock credit units in turn being coordinated with progressive accumulation of cash credit units, such advancement in said first progress section also being coordinated in part with progress of the players' playing tokens in their respective second progress sections; a second progress section having a plurality of sequentially arranged playing token resting spaces provided with indicia signifying increasing years of corporate service from the first to the last resting space;

separate playing tokens for said playing section and each of said progress sections, said playing tokens being adapted to be moved sequentially through said playing section and said progress sections;

said playing tokens being provided with distinctive indicia to distinguish the playing tokens of each player from those of each other player;

a first set of instruction cards, such cards being provided with a plurality of mandatory instructions to players to perform optional, simulated business activities; a second set of opportunity instruction cards for dealing to the players, the instructions of which may be performed by the players at their respective options during any of their respective playing turns, so as to enable the players to exercise some discretion in the movement of their playing tokens;

random selection means for operation by a player during his playing turn to direct such player to move his playing token circuitously about the playing token resting spaces, the length of the path of such movement being determined by the random selection means; and stock share price indicating means, adapted to indicate randomly selected share prices at which simulated purchase of stock shares can be made.

* * * * *